US008001818B2

(12) United States Patent
Imedio Ocaña et al.

(10) Patent No.: US 8,001,818 B2
(45) Date of Patent: Aug. 23, 2011

(54) CLUTCH MECHANISM COUPLABLE TO DOOR LOCKS WITH LOCKING BOLT OPERATED BY HANDLES OR KNOBS

(75) Inventors: Juan Antonio Imedio Ocaña, Hondarribia Guipuzcoa (ES); Carlos Ferreira Sánchez, Hondarribia Guipuzcoa (ES)

(73) Assignee: Salto Systems, S.L., Oiartzun (Guipuzcoa) (ES)

( * ) Notice: Subject to any disclaimer, the term of this patent is extended or adjusted under 35 U.S.C. 154(b) by 0 days.

(21) Appl. No.: 11/819,102

(22) Filed: Jun. 25, 2007

(65) Prior Publication Data

US 2008/0011030 A1 Jan. 17, 2008

(30) Foreign Application Priority Data

Jun. 26, 2006 (ES) ..... 200601707

(51) Int. Cl.
*E05B 55/04* (2006.01)
*E05B 47/06* (2006.01)

(52) U.S. Cl. ..... 70/472; 70/218; 70/222; 70/283

(58) Field of Classification Search ..... 70/189, 70/218, 222, 224, 277, 278.7, 283, 467, 472
See application file for complete search history.

(56) References Cited

U.S. PATENT DOCUMENTS

| | | | | |
|---|---|---|---|---|
| 5,475,996 | A * | 12/1995 | Chen | 70/277 |
| 5,640,863 | A * | 6/1997 | Frolov | 70/277 |
| 5,987,945 | A * | 11/1999 | Ruano Aramburu | 70/277 |
| 6,286,347 | B1 * | 9/2001 | Frolov | 70/472 |
| 6,427,505 | B2 * | 8/2002 | Imedio Ocana | 70/278.7 |
| 6,651,468 | B2 * | 11/2003 | Aramburu et al. | 70/222 |
| 6,837,081 | B2 * | 1/2005 | Ruano Aramburu et al. | 70/222 |
| 6,845,642 | B2 * | 1/2005 | Imedio Ocana | 70/277 |
| 7,007,526 | B2 * | 3/2006 | Frolov et al. | 70/277 |
| 7,096,698 | B2 * | 8/2006 | Walsh et al. | 70/277 |
| 7,168,276 | B2 * | 1/2007 | Errani et al. | 70/278.7 |
| 7,308,810 | B2 * | 12/2007 | Menta San Miguel | 70/472 |

* cited by examiner

*Primary Examiner* — Suzanne D Barrett
*Assistant Examiner* — Christopher Boswell
(74) *Attorney, Agent, or Firm* — Wenderoth, Lind & Ponack, L.L.P.

(57) ABSTRACT

A clutch mechanism permits a pulling movement to be transferred or not to the bolt of a lock when turning the internal or external handles attached to separate square-section shafts belonging to clutch elements and which can have independent rotation or they can do so integrally. A first clutch element connected to the outside handle possesses a prismatic projection with a radial orifice into which fits a pulling pin assisted by a spring and which is able to be displaced in order to be introduced into a slot of a second clutch element. The movement is controlled by a motor with a worm-screw linked to a spring which can displace a thruster rocker arm which makes contact with the pulling pin. The mechanism also includes an emergency device having a rod and another spring linked to the thruster rocker arm.

9 Claims, 11 Drawing Sheets

CLUTCH MECHANISM COUPLABLE TO DOOR LOCKS WITH LOCKING BOLT OPERATED BY HANDLES OR KNOBS

BACKGROUND OF THE INVENTION

I. Field of the Invention

The present invention relates to a clutch mechanism couplable to door locks with a locking bolt operated by handles or knobs, which incorporates notable advantages compared to mechanisms currently existing and having the same end, and has certain narrow dimensions in order to prevent the mechanism from significantly projecting with respect to the doors in which it is fitted, and that it may include a minimum number of pieces and be able to be used both in a normal position and reversed position so that it can be adapted to any type of door, thus enabling assembly advantages that lead to economic advantages.

All the component elements are interconnected together in such a way that there is no weakening of the mechanism and the mechanism is very compact.

II. Description of the Related Art

Basically two inventions make up the prior art. These two devices are described in EP patent 0848779 U.S. Pat. No. 6,286,347.

The first reference (EP 0848779) describes a clutch mechanism for an interconnection for locking, blocking and unblocking of a lock, which can be displaced by an inside handle and also by means of an outside handle via an actuator.

A motor is provided which, by means of a spring shaft, connects with a screw which permits displacement of a drive lever. The drive lever acts on a thrust arm or injector with a spring with pushes the arm outwards. This arm is in turn in contact with another coupling arm capable of being introduced against the action of a spring, and into a slot of a rotating drive disc connected to the arm of the lock. An arched projection has likewise been provided in order to allow the coupling arm to rotate outside of the line of the arm of the injector, a gap existing in the arched projection in order to allow the alignment and engagement between the arms.

U.S. Pat. No. 6,286,347 describes a variant of the above patent in that the arm is connected to an arched transverse member where it supports the coupling arm. In this case, the way in which the coupling arm is pushed in order to be introduced into the slot of the drive disc is via this transverse guide member.

The number of pieces required in these solutions raises problems of dimensioning, and the result is a unit of considerable thickness which projects too much when it is fitted to doors.

Equally, the actual functional requirements of the different pieces means that the unit's application is very limited.

When the lock is operated, the play between the spring of the drive lever and those for the thrust arm and the coupling arm, along with the alignment of these in the gap in the guide member, also raise problems in the stabilization and compacting of the lock, which shows positions that are certainly weakened when the outside handle is displaced.

SUMMARY OF THE INVENTION

In general terms, the object of the present invention relates to a clutch mechanism couplable to door locks with a locking bolt operated by handles or knobs is enclosed within a casing which will be superimposed on the outside of the door and coupled to the square-section shaft of the actuation system for the locking bolt. By means of this clutch mechanism, a pulling movement is or is not transmitted to the bolt from the outside.

Engagement of the clutch is preferably carried out with the actuation of a small motor inside the casing which produces the rotation of a worm-screw which in turn controls the displacement of a radial pin which, when actuated, performs the clutch operation. When the mechanism is at rest the pin is retracted and the rotation of the handle or knob on the outside does not entail pulling of the lever which causes the displacement of the locking bolt.

Instead of being a motor, the drive unit can be replaced with another means, such as for example a numeric or alphanumeric key-pad or any other electronic control device, or even by means of a mechanical mechanism.

The clutch mechanism itself consists of two pieces rotating with respect to each other and coaxial, one of which is integral with the square-section shaft which has access to the outside of the door. The other clutch element is aligned with it and has a housing for inserting of the square-section shaft as an extension, which traverses the tumbler of the lock embedded in the door and reaches as far as the inside where it is connected to the inside handle or knob.

When the outside handle is turned, no movement is obtained in the locking bolt if this second element, connected to the inside handle, is not connected to the clutch. When both elements are interconnected then the locking bolt can be displaced to its opening position.

The element forming the clutch is defined by a pin which occupies a radial position in one of the clutch elements, which is able to be introduced into a notch or slot provided in the other clutch element so that they both become integral with each other when they rotate.

The pin has an end that is radially further away and is not the operational end as far as the receiver notch is concerned, and it is assisted by a spring which keeps it retracted in such a way that its exit is prevented when support is established with an arched guide concentric with the axis of rotation of the handles or knobs, provided in the interior body. This same end of the pulling pin is also in contact with a thruster rocker arm which is forced to rotate when the worm-screw of the drive unit does so, with the mediation of a spiral spring with its ends extended in separate arms, one of which rests between two contiguous spirals of the worm-screw while the other is retained in a projection of the rocker arm. When the arm connected to the worm-screw approaches an angle with respect to the arm attached to the thruster rocker arm, the latter is displaced at an angle pushing the pin and forcing it to become introduced into the notch of the second element of the clutch mechanism. Under these conditions, when the outside handle is turned, retraction of the locking bolt does indeed take place as the two square-section shafts linked to the respective elements of the clutch system become integral with each other.

At the moment in which the outside handle ceases to be turned and returns to its rest position, the pin exits from the slot due to the action of the coaxial spring which assists it, since the thruster rocker arm will already have receded to its original housing position with respect to the pin.

As discussed below in relation to the figures, a provision has also been made so that in the event that the access control mechanism fails to work, the thruster rocker arm does not move at an angle that pushes the pin and produces engagement of the clutch. In this case there exists an emergency system which is activated by means of an emergency key the cam of which axially drives a sliding lever which acts on the arm of a second spring similar to the previous one and whose other end pushes the rocker arm so that it is displaced at an angle in the same way as was done by means of the worm-screw.

In order to facilitate an understanding of the characteristics of the invention and forming an integral part of this descriptive specification, drawings are attached in which figures, on an illustrative rather than limiting basis, the following has been represented:

DESCRIPTION OF THE PREFERRED FORM OF EMBODIMENT

Figure 1:
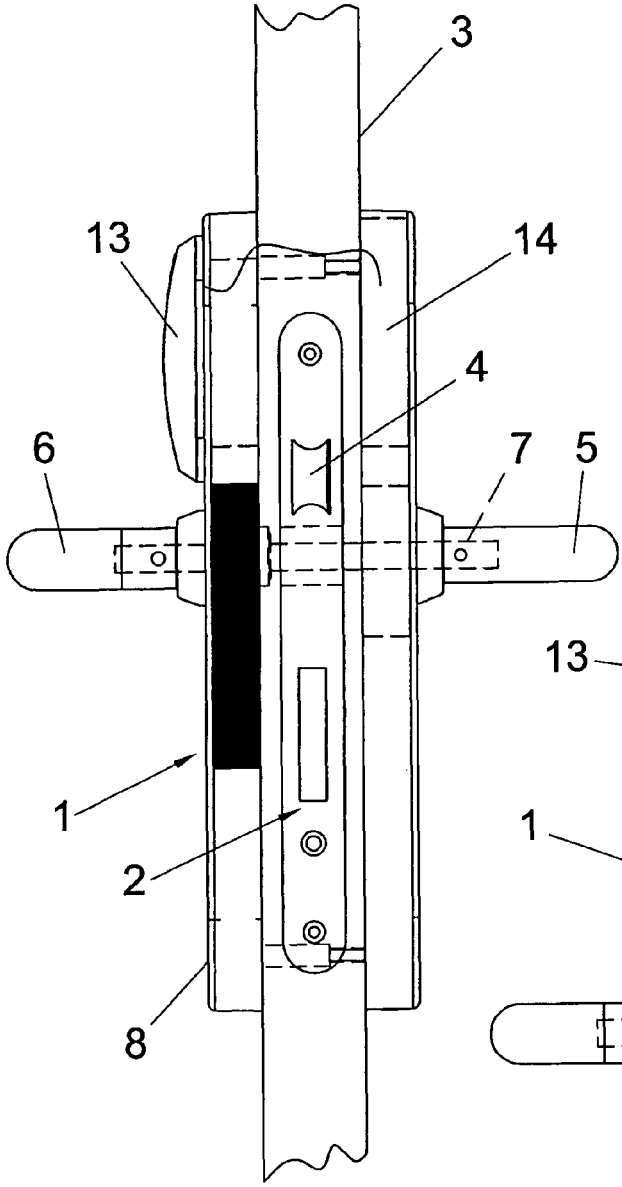
FIG. 1. —Is a partial view in profile of a door fitted with a lock provided with the clutch mechanism of the invention.

With reference to the numbering adopted in the figures, the clutch mechanism couplable to door locks with a locking bolt operated by handles or knobs, according to the present invention, is referenced in general with the reference number 1 and its location can be seen diagrammatically in FIG. 1. Clutch mechanism 1 is couplable to the lock 2 or 2' attached to the side of the door 3 and whose locking bolt 4 is actuated by turning the inside 5 or outside 6 handle fitted in the ends of the square-section shaft 7 when engagement of the clutch has taken place, as described below. The clutch mechanism 1 remains hidden beneath the plate of the lock 8 which can in turn consist of a frame covered with an embellisher.

The clutch mechanism contains an interior body 10 which houses virtually all the mechanisms and a protective cover 9 integral with the above and which provides anti-drill protection.

As drive unit, a motor 11 has been provided which, via the corresponding transmission body (not represented), causes a worm-screw 12 to rotate.

Figure 2:
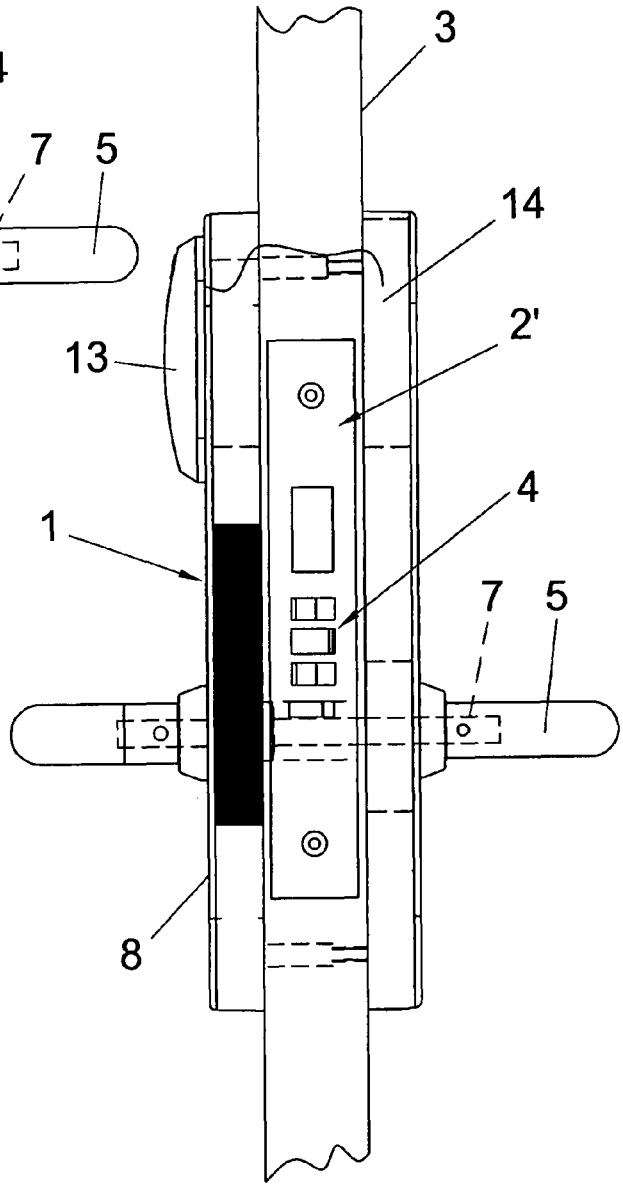
FIG. 2. —Is a view similar to FIG. 1 with the clutch mechanism applied to a different lock.

In FIGS. 1 and 2 it can be seen that a reader 13 has been provided, which is powered by batteries 14 in order to permit reading of an electronic card.

The clutch mechanism includes the clutch elements 15 and 16, the element 15 being the one which we will call the first clutch element and is connected to the outside handle 6, while the other clutch element, or second element 16, is connected to the inside handle 5 and is integral with the square-section shaft 17 (see FIG. 3) and is the one that acts on the locking bolt 4. This second clutch element 16 constitutes in itself the element that is connected to the locking bolt of the lock and which, when turning, whether due to the actual inside handle 5 or due to the mediation of the clutch element 16 via the outside handle 6 when these elements are interconnected, as we will see later on, permits said locking bolt to be displaced to its opening position.

The first clutch element 15 includes a square-section spike 18 for connection with the outside handle 6. Spike 18 ends with a head or disc 19 in which, perpendicular to the plane of disc 19 and via its periphery, provision has been made for a tab 20 which enables the end of the spring 21 to be supported. The other end of spike 18 is supported on a projection of the interior body 10, as is habitual, so that it can recover its initial rest position. The rotary displacement of the first clutch element 15 is performed against the action of said spring 21.

Figure 3:
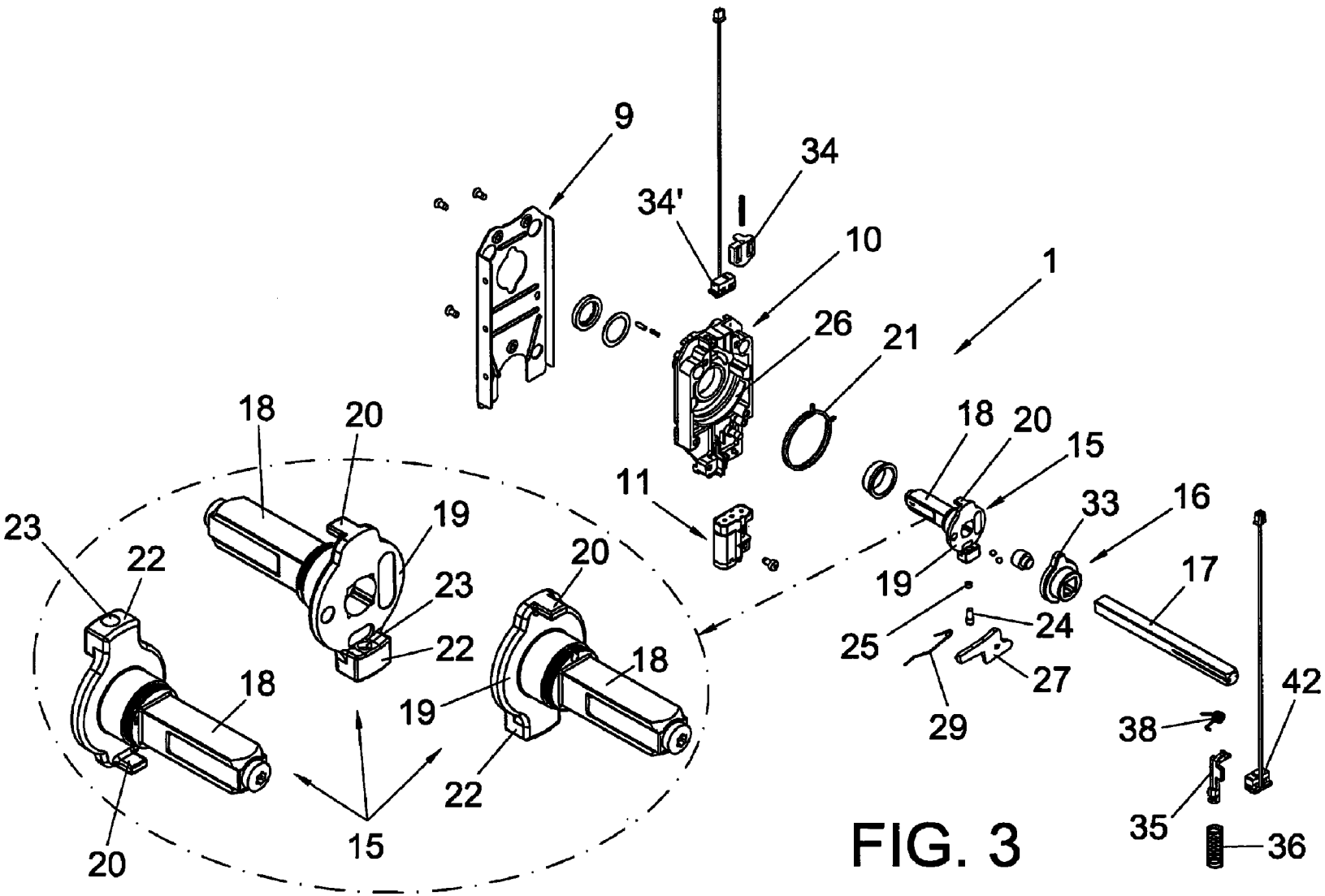
FIG. 3. —Is a perspective exploded view of the components of the clutch mechanism of the invention.

Also provided on head or disc 19 is a prismatic projection 22 arranged to be diametrically opposite to tab 20, in which an orifice 23 is made in which is fitted pulling pin 24, which is constantly pushed towards the outside of the radial orifice 23 (see FIG. 3) and in the direction away from the axis of rotation of the second clutch element 16 by the action of the coaxial spring 25 which assists it. The length of this pulling pin 24 is such that its end that is radially furthest away, when it projects due to the action of its spring 25 through the lower part of the prismatic projection 22, is at all times in contact with the arched support guide 26 of the interior body 10 (as seen in FIG. 3).

In turn, the end of the pulling pin 24 is simultaneously in contact with the edge of the thruster rocker arm 27 which rotates in an oscillating fashion around the axis 28 and is assisted by the spring 29 rolled around the pivot which defines the axis 28 of oscillation of the thruster rocker arm 27 and in such a way that one of its ends (referenced with 30) intercepts the worm-screw 12 driven by the motor 11. The other end 31 of the spring 29 rests on the lower part of the thruster rocker arm 27. The displacement of the end 30 by the worm-screw 12 permits the spring 29 to flex in such a way that it pushes on the rocker arm 27 so that it can push on the pulling pin 24 which partially enters into the slot 32 (see FIG. 8) of the second clutch element 16 against its spring 25. The action of the spring 29 is greater than that of the spring 25.

Therefore, once the pulling pin 24 is introduced into the slot 32, the first and second elements of the clutch become connected in such a way that when one of them turns the other also turns, displacing bolt 4 of the lock 2 or 2'.

In the displacement from the open position at rest to open turned, the opening tension, which is created against the action of the spring 21 and of the tumbler spring of the lock 2-2' and the actual friction of the pulling pin 24 against the walls of the slot 32, is sufficient so that pin 24 is not displaced outwards by the action of its spring.

At the moment that the outside handle 6 ceases to be acted upon and it returns to its horizontal position, the spring 25 pushes the pin 24 so that it exits from the slot 32.

One of the important characteristics of the structure lies in the position of the arched guide 26 which is concentric with the axis of rotation of the clutch elements 15 and 16 and which is extended by an angle similar to that of rotation of the handles. In any position, including the locked position, when pulling pin 24 is outside of the slot 32, it has its end, at all times, in contact with the arched guide 26. Therefore, the actuation operations on the handles are compact and stable operations without any variations in the resistance to overcome and without any weakened position, via a rigid and continuous guide, and not, as in the case with EP0848779 mentioned earlier, a gap between the arched projection and the coupling arm and not, as in the case of U.S. Pat. No. 6,286,347, a large moving element which can have problems being displaced correctly due to the transverse force components originated when the pulling pin 24 is close to the ends. The clutch element 16, as well as the slot 32, is connected via a cam 34 with a micro-switch 34' (see FIG. 3) which is in turn connected to a control system in such a way that, via it, the rotation of the handle can be detected and can be processed by a computer.

Figure 4:
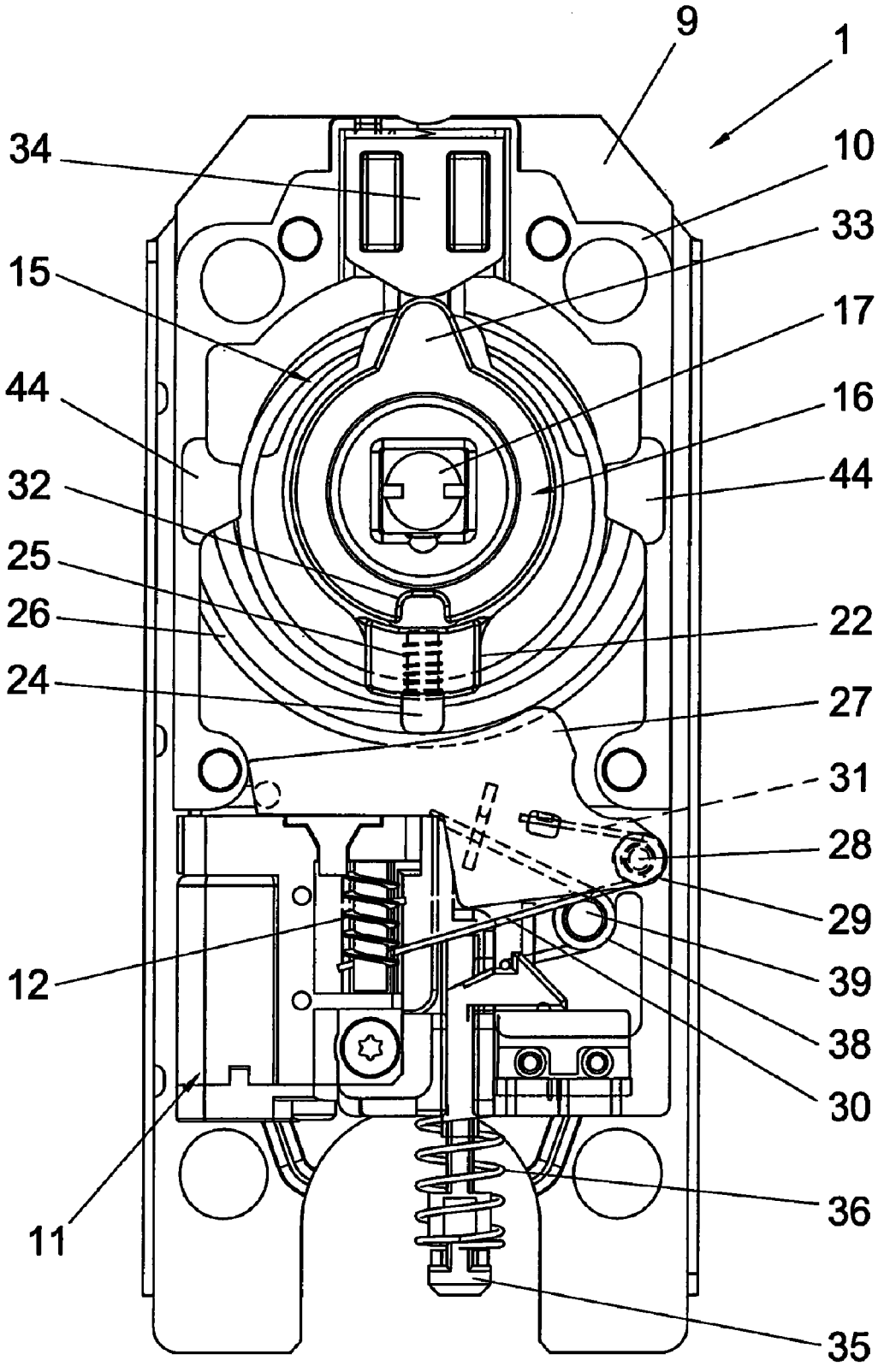
FIG. 4. —Is a plan view of the clutch mechanism of FIG. 3, with all components assembled, with the exception of the cover enclosing the casing and in a door closed position and without actuating the motor.

FIG. 4 shows the closed position, when the two locking handles are inoperable and the motor 3 is not in operation.

Figure 5:
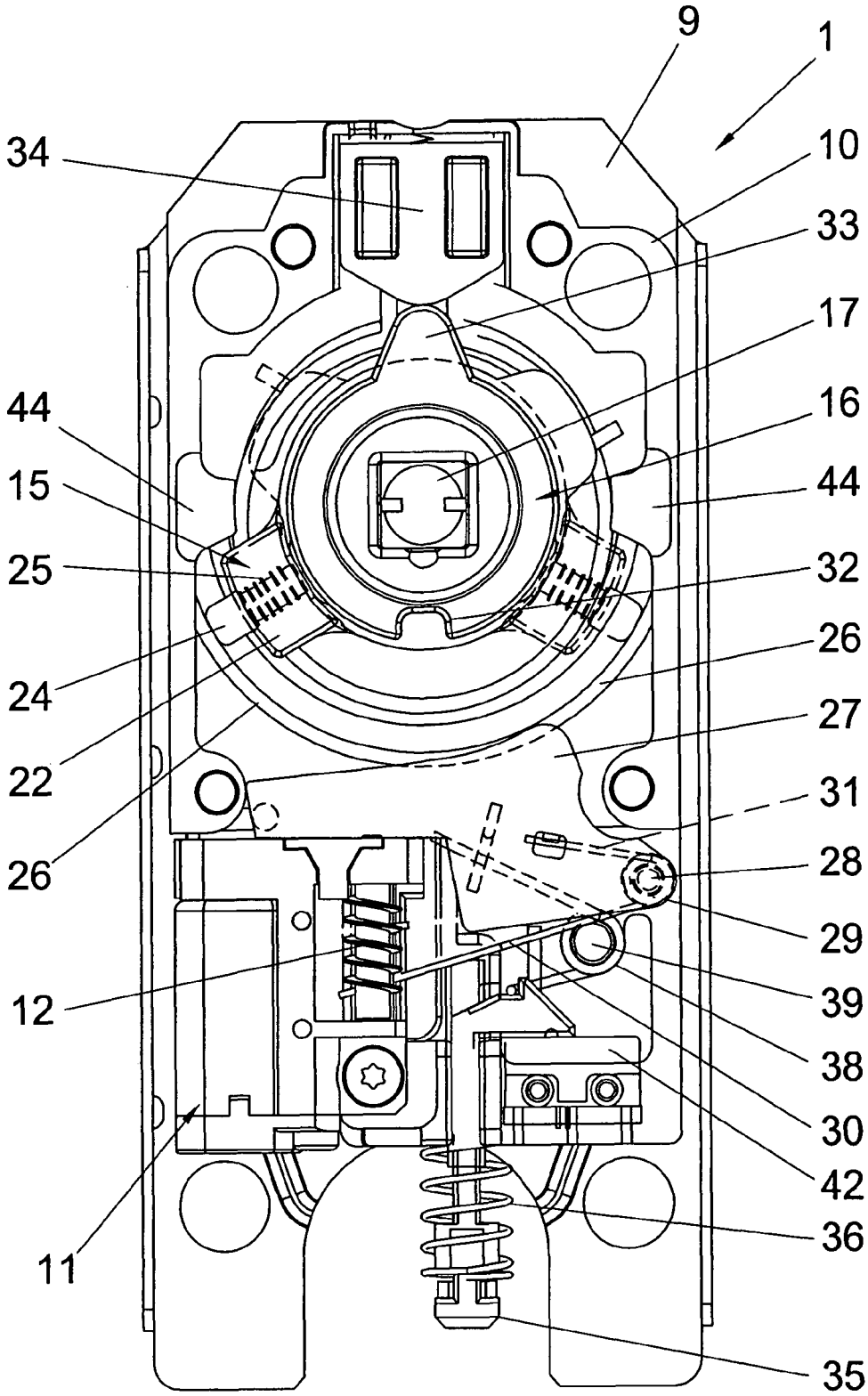
FIG. 5. —Is a similar view to FIG. 4, with the outside handle having been turned, such that the door cannot be opened, or the bolt cannot be retracted.

Represented in FIG. 5 is the closed position in which the motor 11 is not activated and in which rotation of the outside handle 6 is produced in order to open the door. In this situation, however, the opening of the door cannot be achieved because the clutch elements 15 and 16 are not connected by the pin 24 and therefore the second clutch element 16 is not displaced in order to pull on the locking bolt 4 of the lock 2. It can be seen that pulling pin 24 is in position and can slide with its rounded end supported on the arched guide 26.

Figure 6:
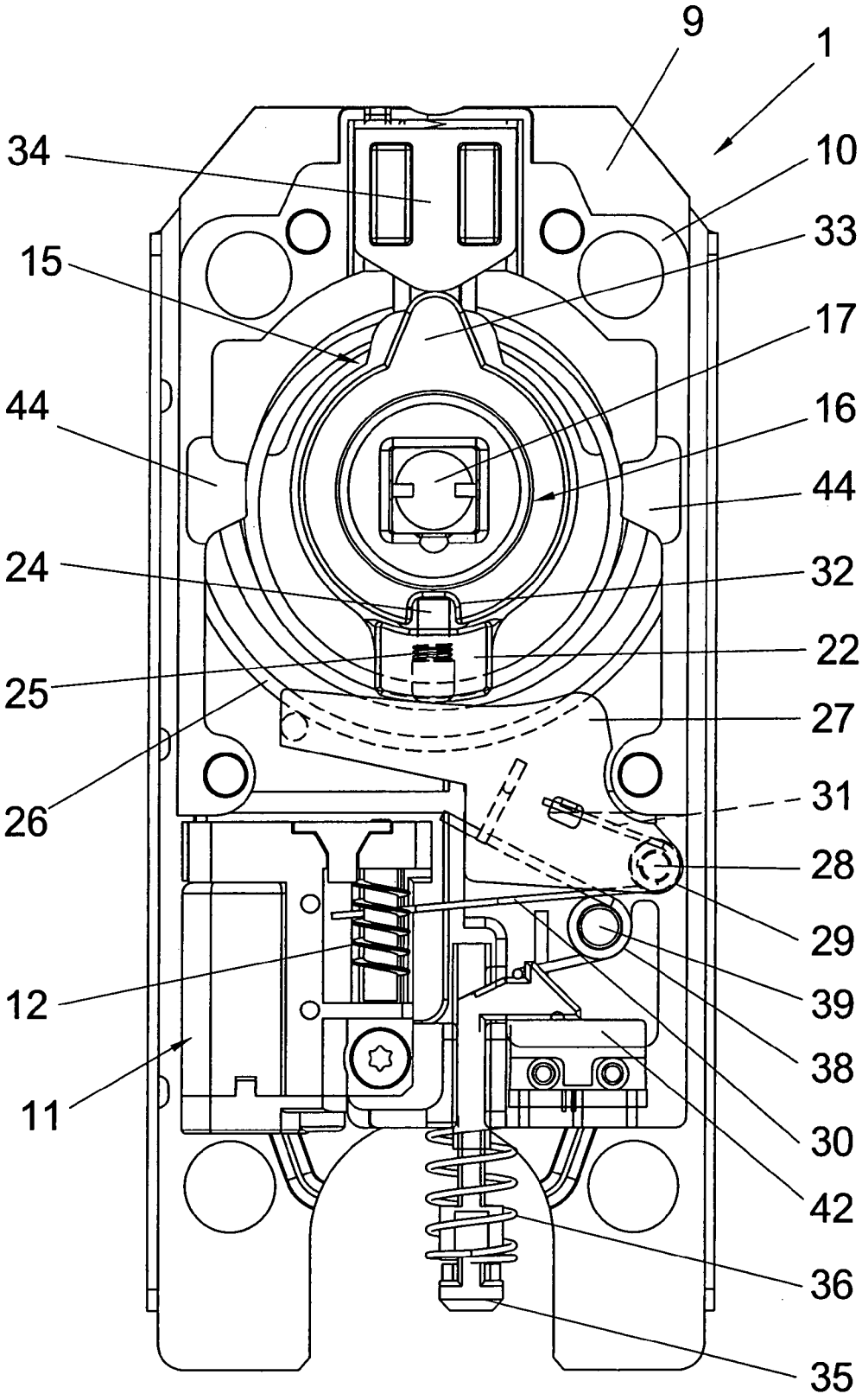
FIG. 6. —Is a similar view to FIGS. 4 and 5, with the clutch mechanism in the rest position but with the motor actuated producing engagement of the clutch, thus permitting the door to be opened when the outside handle is turned.

Represented in FIG. 6 is the rest position but in which the motor 11 has already been activated via the access control system, such as for example via the reader 13 (see FIGS. 1 and 2) and the corresponding access card. In this case, by means of the motor 11 and the worm-screw 12, the spring 29 is pushed so that the thruster rocker arm 27 can rotate and in turn push on the pulling pin 24 against its spring in order to be partially introduced inside the slot 32. In this case, and going on now to FIG. 7, the turning of the outside handle 6, due to the two clutch elements 15 and 16 being connected, causes the second clutch element 16 to be pulled on, producing the subsequent displacement of the locking bolt to its open position.

Figure 7:
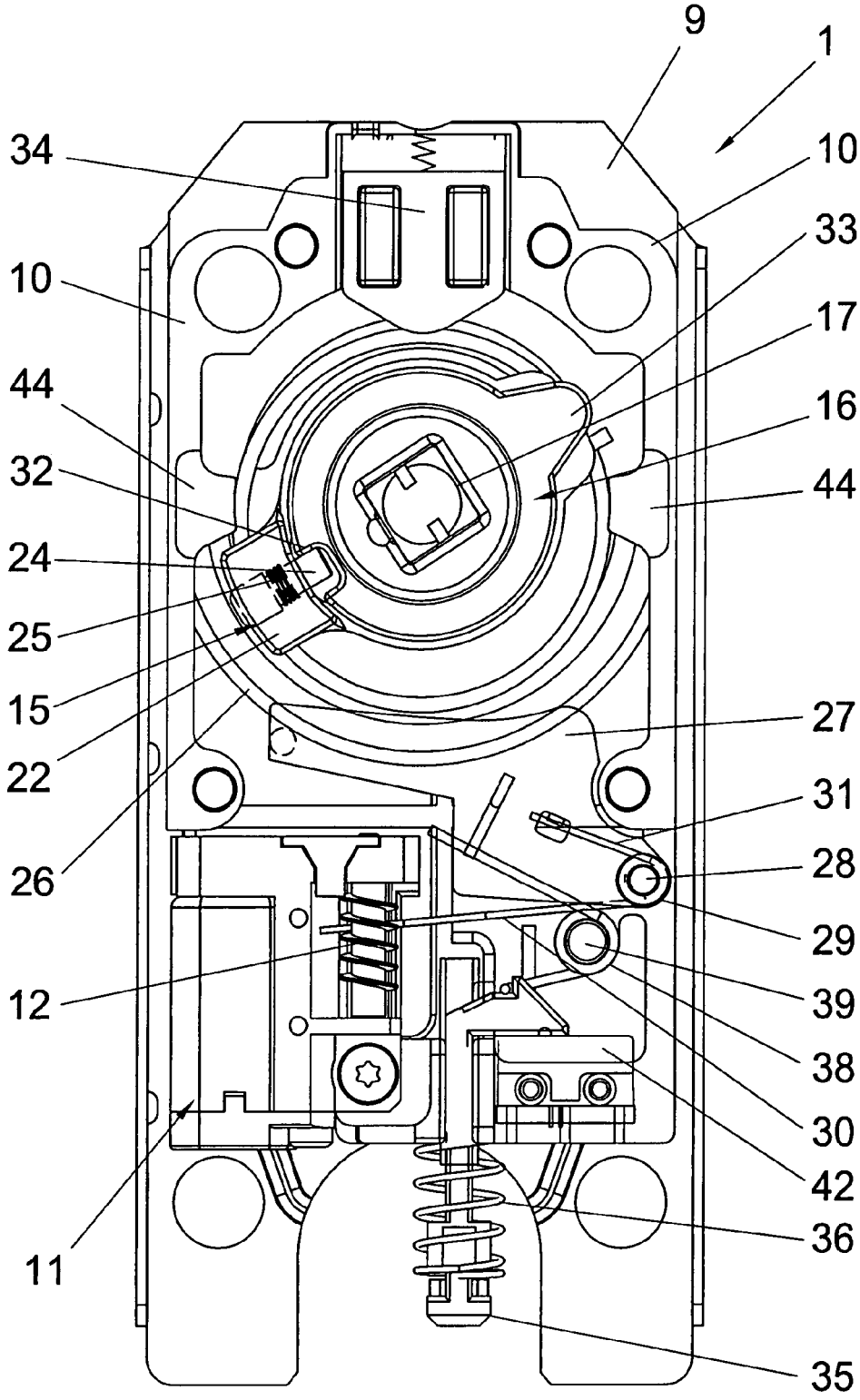
FIG. 7. —Is a similar view to FIG. 6, under the same conditions as the latter but with the outside handle having been turned.
Figure 8:
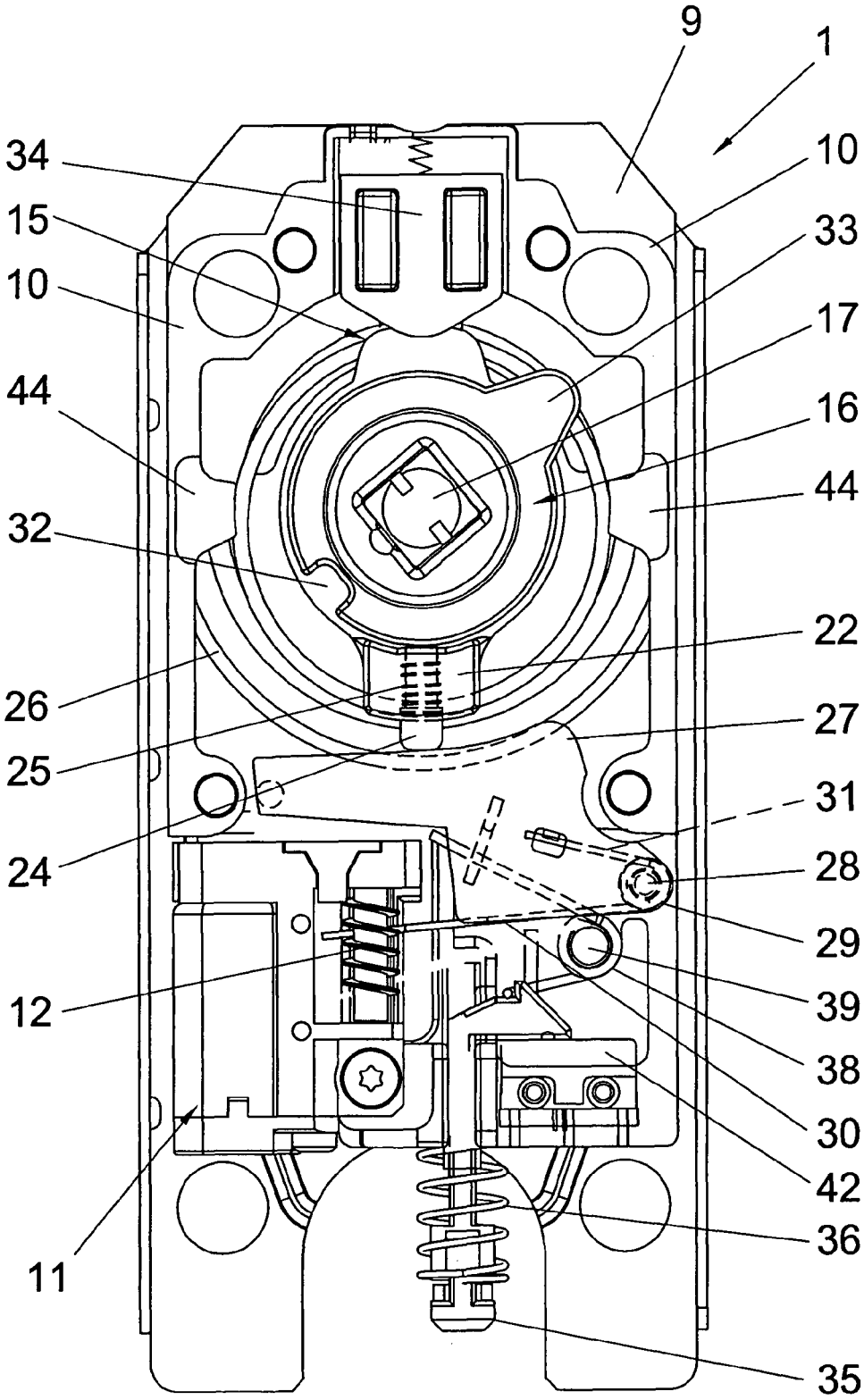
FIG. 8. —Is a similar view to FIG. 4, once the inside handle has been turned.

Represented in FIG. 8 is the open position in which the motor 11 has been actuated as in the case of FIGS. 6 and 7, but in FIG. 8, displacement of the locking bolt has taken place via the inside handle 5 and subsequently rotation of the second clutch element 16. The rotary displacement of the thruster rocker arm 27 does not produce displacement of the pulling pin 24 because the end of the latter is flush against the cylindrical periphery of the second clutch element 16 due to the slot 32 having been displaced. In this position of FIG. 8, the inside handle 5 has been actuated.

Figure 9:
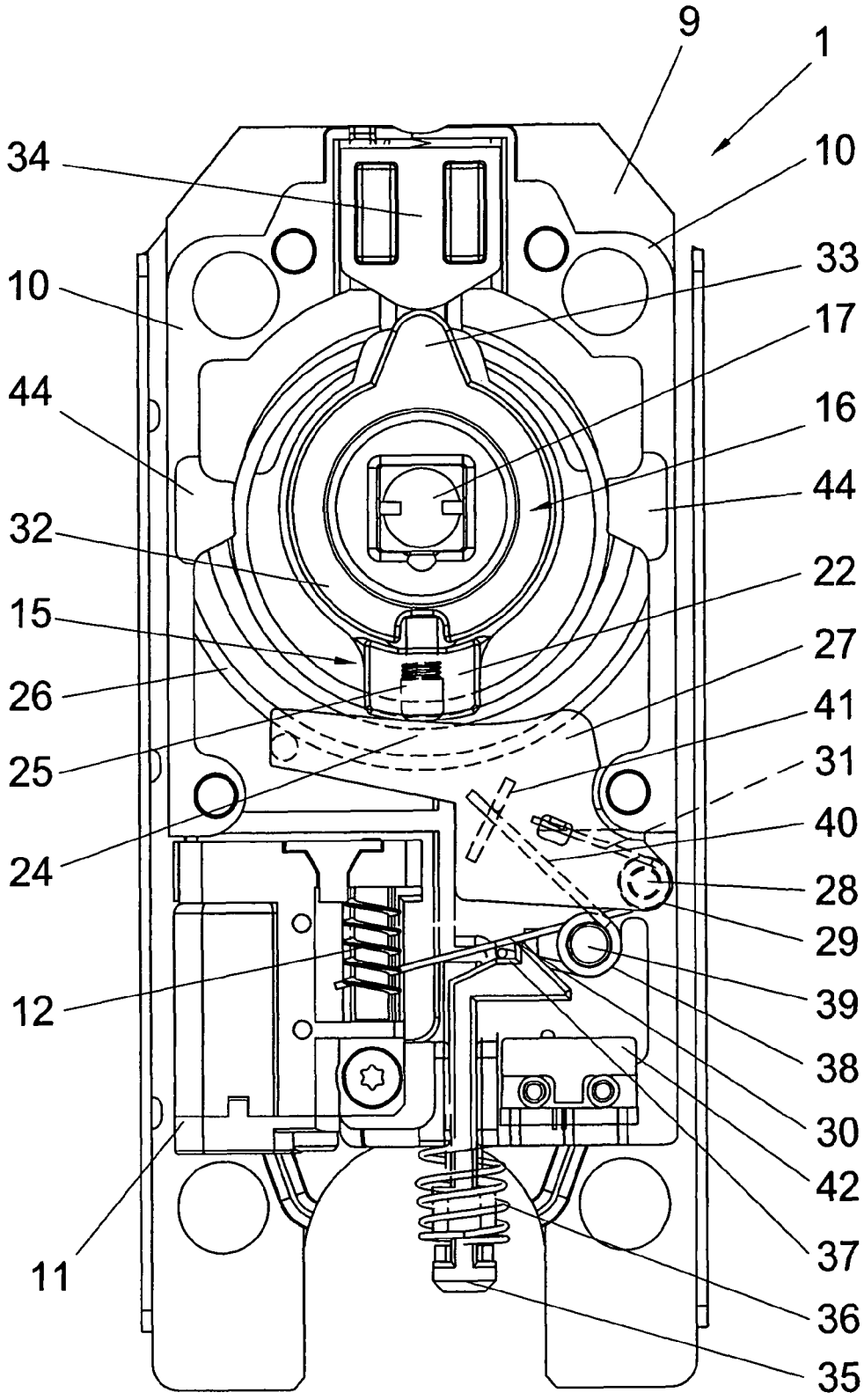
FIG. 9. —Is a similar view to FIG. 4, once the emergency opening has been actuated so that the clutch can be operated in order to permit opening when the outside handle is turned.

FIG. 9 represents the emergency system wherein an actuation thereof causes engagement of the clutch in the event that the access control mechanism fails to operate. It consists of an emergency push-rod 35 whose displacement against the spring 36 is carried out by certain means that are not represented and actuated by an emergency key which is also not represented.

The end of the push-rod 35 has a special configuration by way of a lateral extension or nose in which a small depression 37 has been provided for supporting the bend end of a flexing spring 38 wound in a spiral and mounted on the stud 39 also emerging from the interior body 10, its end 40 being extended in order to form a support in the projection 41 of the rocker arm 27. The displacement of the thruster rocker arm 27 causes the spring 38 to flex so that its end 40 exerts pressure on the rocker arm 27 and the latter on the pulling pin 24, forcing it to enter the slot 32 of the second clutch element, thereby achieving that both clutch elements 15 and 16 remain integral in their rotation and so displacement of the locking bolt 4 is permitted.

Provision has been made for a micro-switch 42 on which the end nose of the push-rod 35 is constantly supported, in such a way that when the latter is actuated upon in an emergency operation, the micro-switch 42 opens and its signal is sent to the computing system which memorizes or stores this operation in memory in order to check whether an emergency actuation has been effected and when the operation was effected.

Figure 10:
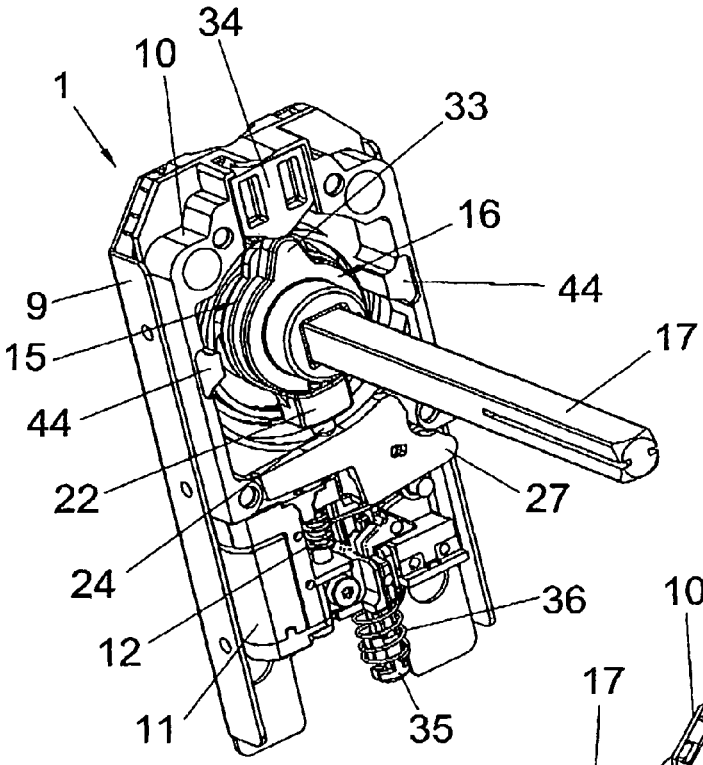
FIG. 10. —Is a perspective view of the same clutch mechanism in the rest position as shown in FIG. 4.
Figure 11:
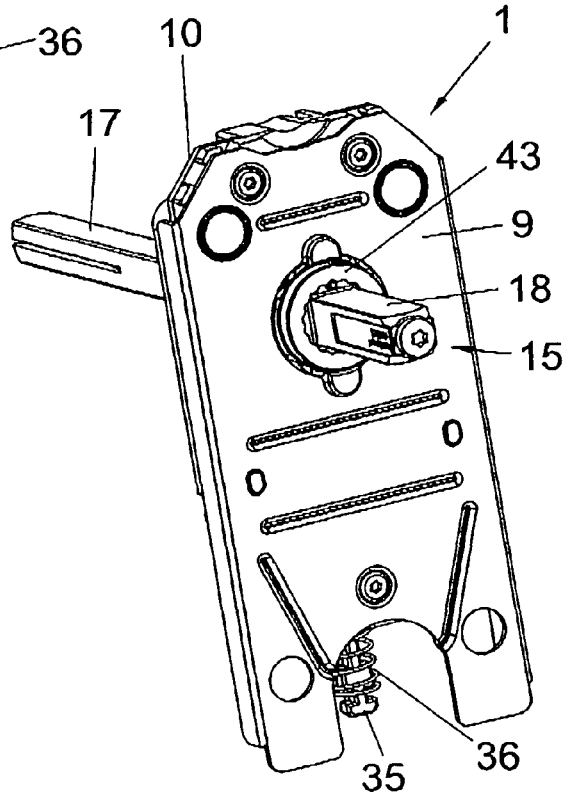
FIG. 11. —Is a perspective view similar to that of FIG. 10, from the opposite side.

In FIGS. 10 and 11 the entire clutch mechanism 1 is shown and on its front face can be seen the protective cover 9 and protective plate 43 in order to prevent vandals from drilling into clutch element 15.

Also shown is an adjusting nut which threads on the cylindrical part of the first clutch element 15 in order to prevent any play in the rotating shaft of the outside handle.

With this is one arrangement presented by the clutch mechanism of the invention, various applications are permitted, such as those shown in FIGS. 1 and 2 in which the mechanism can be fitted in one position or its reverse without the different components having any functional problems on account of occupying these different positions.

The rotating stop of the outside handle 6 is performed by the actual prismatic projection 22 of the first clutch element 15, in such a way that when it rotates it acts as a stop against the projections 44 provided on one and the other side in the interior body 10.

Figure 12:
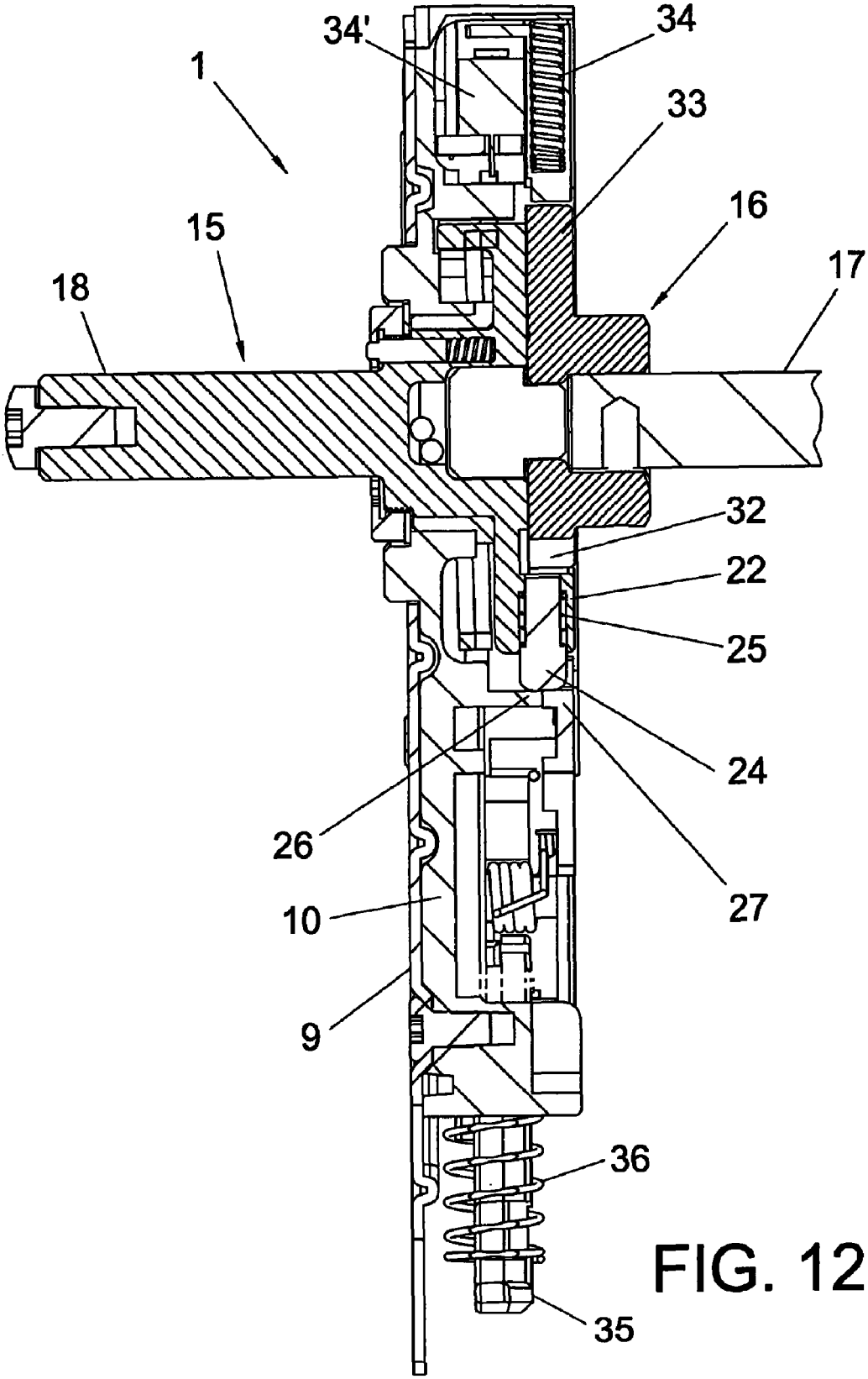
FIG. 12. —Is a transverse cross-section in longitudinal elevation of the same clutch mechanism, in the rest position.
Figure 13:
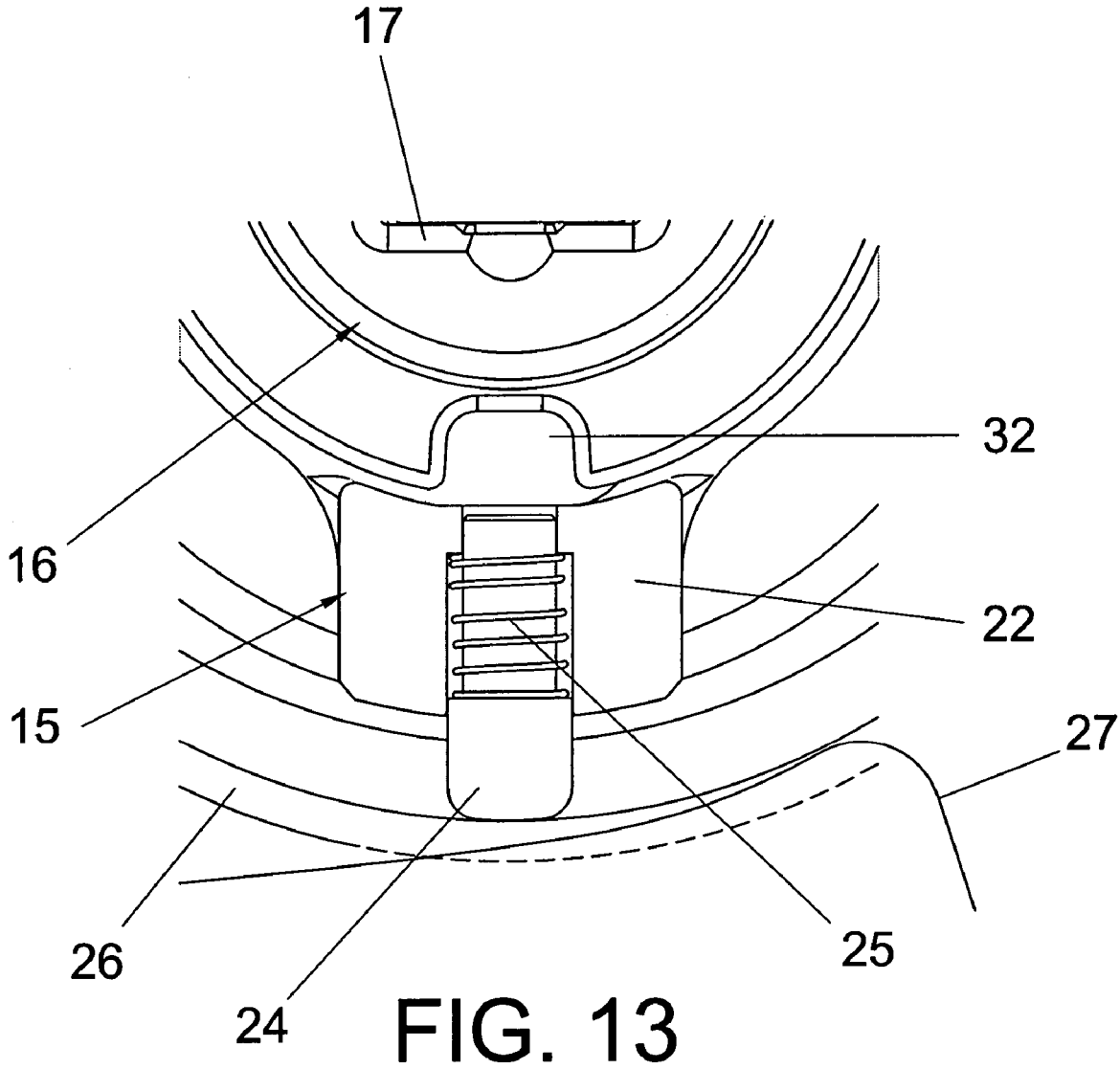
FIG. 13. —Is an enlarged detailed view of the actual clutch mechanism, in the declutched position or position of retraction of the pin with respect to the receiver notch.

FIG. 12 shows a longitudinal cross-section of the clutch mechanism 1 and it can be seen how the pulling pin 24 guided in the prismatic projection 22 is supported on the arched guide 26 and in the thruster rocker arm 27, in such a way that the latter, when displaced upwards, can easily cause the pulling pin 24 to be housed in the slot 32 of the second clutch element 16.

The control for the motor can be carried out by other means, such as for example a numeric or alphabetic key-pad or any other electronic control device. Equally, the control can be done by means of a mechanical mechanism.

The invention claimed is:

1. A clutch mechanism for coupling with a door lock mounted in a casing superimposed on a door, the door lock having a locking bolt operated by an outside handle and an inside handle, said clutch mechanism comprising:

an interior body having an arched guide;

a worm screw disposed in said interior body;

a first clutch element disposed in said interior body and having a first square-section spike configured to connect to the outside handle, a head or disk fitted with an eccentric, axial tab, and a prismatic projection diametrically opposite said eccentric, axial tab, said eccentric, axial tab being configured to turn with said first square-section spike and said projection having an orifice;

a second clutch element disposed in said interior body and having a slot and a second square-section spike configured to connect to the inside handle, said second clutch element configured to operate the locking bolt of the door lock;

a first spring having a first end and a second end, said first end engaging said eccentric, axial tab and said second end being fixed to said projection, said first spring being arranged to enable recovery of the inside and outside handles;

a pulling pin radially disposed, with respect to said head or disc, in said orifice;

a second spring arranged to bias said pulling pin radially outwardly;

a thruster rocker arm having an upper surface and being pivotally connected to said interior body; and a third spring being arranged between said worm-screw and said thruster rocker arm to bias said thruster rocker arm so as to push said thruster rocker arm against said pulling pin;

wherein when said worm-screw is in an engagement position of the clutch mechanism, said worm screw pushes said thruster rocker arm via said third spring so as to push said pulling pin into said slot of said second clutch element, thereby locking said first clutch element to said second clutch element, such that rotational movement of the outside handle is transferred to said second clutch element to operate the locking bolt;

wherein when in the engagement position of the clutch mechanism, a portion of said thruster rocker arm is disposed in said arched guide, such that said pulling pin is arranged to maintain continuous contact with said arched guide when sliding on said arched guide, and simultaneously maintains continuous contact with an edge of said thruster rocker arm, so as to slide on both said arched guide and the edge of said thruster rocker arm, and wherein continuity of the movement of said pulling pin is provided by said arched guide.

2. A clutch mechanism according to claim 1, further comprising a motor disposed in said interior body and arranged to rotate said worm-screw;

wherein said third spring has a first end supported on an internal projection of said thruster rocker arm and a second end disposed between spirals of said worm-screw such that when said motor rotates said worm-gear, pressure is exerted on said thruster rocker arm, thereby overcoming a force exerted by said second spring on said pulling pin and displacing said pulling pin so that said pulling pin enters said slot of said second clutch element.

3. A clutch mechanism according to claim 1, wherein said second clutch element includes a radial projection diametrically opposite said slot, said radial projection being arranged to contact a micro-switch disposed in said interior body, the micro-switch being operable to communicate with a computer control system for controlling when the lock can be operated and the number of times the lock can be operated.

4. A clutch mechanism according to claim 1, further comprising an emergency opening system including a rod having an outer end and being arranged to be guided into said interior body; and a fourth spring having first and second ends, said second end being supported on a projection of said thruster rocker arm, and being configured to bias said rod in a retracted position so that said outer end can be operated by an emergency key, the emergency key for linearly displacing said rod by pushing directly on said first end, thereby forcing said fourth spring to rotate and displace said pulling pin and locking said first clutch element to said second clutch element.

5. A clutch mechanism according to claim 4, wherein said rod has a lateral extension configured to press a micro-switch, such that when said rod is displaced by the emergency key, the micro-switch opens and sends a signal to be stored in a memory of a computing system, the signal identifying that said rod was displaced and when displacement of said rod was effected.

6. A clutch mechanism according to claim 1, further comprising a protector cover integral with said interior body.

7. A clutch mechanism according to claim 1, wherein said substantially continuous surface is substantially flat.

8. A clutch mechanism according to claim 1, wherein when in the engagement position of the clutch mechanism, said pulling pin slides in a first direction when sliding on said arched guide, and said portion of said thruster rocker arm is disposed in said arched guide so as to be adjacent said arched guide in a second direction, the second direction being transverse to the first direction, such that said pulling pin slides on both said arched guide and the edge of said thruster rocker arm when sliding in the first direction.

9. A clutch mechanism according to claim 1, wherein said third spring has a first end and a second end, said first end intercepting said worm screw and said second end being connected to said thruster rocker arm.

* * * * *